US005519189A

United States Patent [19]

Gibisch

[11] Patent Number: 5,519,189

[45] Date of Patent: May 21, 1996

[54] NON-DESTRUCTIVE DRUM HEATING UNIT

[76] Inventor: Glenn J. Gibisch, 5925 Lyman Ct., Downers Grove, Ill. 60516

[21] Appl. No.: 328,590

[22] Filed: Oct. 24, 1994

[51] Int. Cl.[6] ..... F27D 7/04; F28D 15/00

[52] U.S. Cl. ..... 219/430; 219/420; 392/496; 165/104.28

[58] Field of Search ..... 219/430, 439, 219/420, 421, 441; 392/441, 444, 458, 485, 494, 496; 137/340, 341; 165/104.19, 104.28

[56] References Cited

U.S. PATENT DOCUMENTS

| | | | |
|---|---|---|---|
| 605,139 | 6/1898 | Schock . | |
| 966,507 | 8/1910 | Wright . | |
| 1,170,170 | 2/1916 | Kuhn et al. | 219/430 |
| 1,715,035 | 12/1927 | Hoyt | 219/430 |
| 2,236,837 | 4/1939 | Rimmel | 219/439 |
| 2,649,380 | 8/1953 | Flynn . | |
| 2,794,195 | 6/1957 | Kaye . | |
| 3,082,776 | 3/1963 | Stauffer . | |
| 3,406,073 | 10/1968 | Palm . | |
| 3,529,610 | 9/1970 | Leichner et al. . | |
| 3,930,879 | 1/1976 | Erickson et al. . | |
| 3,984,656 | 10/1976 | Morgan | 219/439 |
| 4,092,111 | 5/1978 | Gaignoux et al. . | |
| 4,179,986 | 12/1979 | Mencacci . | |
| 4,363,153 | 12/1982 | Carava . | |
| 4,905,325 | 3/1990 | Colditz . | |
| 4,919,308 | 4/1990 | Majkrzak | 222/146.5 |
| 5,067,710 | 11/1991 | Nagashima et al. | 392/461 |

FOREIGN PATENT DOCUMENTS

| | | |
|---|---|---|
| 263607 | 12/1949 | Switzerland . |
| 1237431 | 6/1971 | United Kingdom . |

*Primary Examiner*—Teresa J. Walberg
*Assistant Examiner*—J. Pelham
*Attorney, Agent, or Firm*—Julian C. Renfro

[57] ABSTRACT

A heating unit for heating a generally cylindrically-shaped drum of material to a selected safe temperature without endangering the contents of the drum due to overheating, such heating unit comprising a tub, liquid circulation components interconnected with the tub, and heating components for heating, to a selected temperature, the liquid to be circulated through the tub. The tub has relatively high sides and an interior portion configured to receive a drum therein, with the interior portion of the tub adapted to contain a number of gallons of liquid to be heated. The tub, liquid circulation components and heating components are interconnected such that the liquid circulation components can bring about a substantially continuous flow of heated liquid through the tub. The heating components have a thermostatically controlled heating element for heating the flowing liquid to a selected temperature. The operation of the liquid circulation components causes the circulation of liquid through the heating components and around a drum of material residing in the tub, thus to raise the temperature of the material in the drum to a temperature that does not exceed the temperature of the circulating liquid.

24 Claims, 3 Drawing Sheets

NON-DESTRUCTIVE DRUM HEATING UNIT

FIELD OF THE INVENTION

This invention relates to the heating of a closed container to a selected temperature, and more particularly to the use of a circulating heated liquid for bringing the material in such a container safely yet rapidly to a preestablished temperature.

BACKGROUND OF THE INVENTION

In a number of industrial applications it is well known to heat drums of liquid material from a storage temperature to a usable temperature, with the use of filament heaters for purposes of this type being commonplace. As an alternative, steam may be utilized for heating drums of material, for by such a means as this, the contents of a drum can be rapidly brought up to a desired temperature.

Although various provisions are made for ostensibly protecting the contents of a drum from overheating, from time to time there is a degree of equipment failure, or the erroneous settings of the maximum temperature to which the contents of the drum will be subjected, in which case the drum and its contents may become overheated. An overheated drum may represent merely the loss of the contents thereof, or in case the drum contains a toxic or potentially toxic substance, the overheating of the drum may provide a distinct hazard to personnel as well as to the building in which the drum is being heated.

It was to overcome the disadvantages of prior art arrangements of this type that the present invention was evolved.

SUMMARY OF THE INVENTION

In accordance with this invention I provide a non-destructive drum heating unit utilizing a tub through which a heat transfer liquid can be circulated around a drum placed in the tub. Therefore, by carefully controlling the temperature of the heat transfer liquid, overheating of the drum and its contents can be carefully prevented. Although in some instances a glycol based heat transfer liquid could be used, resulting in the heating of the drum beyond the boiling temperature for water, I usually prefer an arrangement in which the circulating heat transfer liquid is water maintained at a selected temperature. In this way, the temperature of the contents of the drum cannot exceed the temperature at which water boils at that particular locale.

I utilize an arrangement in which the temperature of the circulating liquid is carefully controlled, which of course provides a great safety factor, not only for the material being heated, but also from the standpoint of the safety of the workers, for a drum being heated that is filled with an inflammable liquid could readily become overheated should a filamentary heating arrangement of the type commonly used in the industry be improperly set up or improperly operated.

I provide in accordance with this invention, a heating means in the form of a unit for heating a generally cylindrically shaped drum of material to a selected safe temperature without endangering the contents of the drum due to overheating. This novel heating unit comprises a tub member, a liquid circulation means, and a heating means for heating liquid to be circulated through the tub to a selected temperature.

The tub has relatively high sides and an interior portion configured to receive a drum therein, with the interior portion of the tub adapted to contain a number of gallons of the liquid to be heated and to be circulated through the tub and around the drum. The tub and the liquid circulation means each have an inlet port and an outlet port, with the inlet port of the liquid circulation means being connected to the outlet port of the tub, and the outlet port of the liquid circulation means connected via the heating means to the inlet port of the tub. The heating means has thermostatically controlled heating elements for heating the liquid flowing through the heater to a selected temperature. The operation of the liquid circulation means causes the circulation of liquid through the heater and around the drum of material residing in the tub, thus to raise the temperature of the material contained in the drum to a temperature that does not exceed the temperature of the circulating liquid.

The tub or tank is of a size large enough to receive a drum to be heated, with the tank being, for example, large enough to accommodate a 55 gallon drum, although I am not to be limited to this size. The heating means utilized in conjunction with the tank is a special type of electric heater, such as one that is designed to heat a liquid to a selected temperature, which for example may utilize electric power supplied at 240 volts AC. The liquid circulation means I prefer utilizes an electric pump, which serves to pull heat transfer liquid from the bottom of the tub or tank, causes it to pass through the electric heater, and then to be delivered into the tub or tank.

A number of advantages are attributable to my invention, some of which may be enumerated as follows;

1. The use of circulating hot water below 212° F. is a particularly fast method of heating materials stored in drums. Efficiencies are increased 25% to 90% over currently available methods. Heat transfer liquids such as propylene glycol, ethylene glycol or automotive antifreeze can, however, be used in instances in which the use of water is inappropriate.

2. The temperature of circulating liquid can be effectively controlled to prevent interior drum lining damage. Carefully controlled circulating liquid temperatures can also prevent damage to materials being heated. Some chemical products will discolor if heated much over relatively low temperatures such as 160° F.

3. Hazardous materials can be safely heated in accordance with my invention. A leaking drum of flammable materials would be diluted by the hot water or other heat transfer liquid. The electric heating element is totally enclosed within the circulating system, and safely separated from the drum being heated. Thus, contact of flammable vapors with heater elements is quite remote.

4. Any leakage of environmentally hazardous materials would be contained within the circulating tub and system, and a drain valve allows for easy cleanup without employee exposure.

5. The novel heater unit I utilize is designed to be used in conjunction with industrial, chemical, food manufacture and pharmaceutical facilities, either indoors or outdoors. In contrast, a steam unit such as the SO4 Sahara Box manufactured by Benko Products, Inc. is not designed for indoor use.

6. Ready access to the drum being heated is provided, thus enabling materials to be removed from the drum while it is still being heated.

7. The approximate cost to increase the temperature of 55 gallons of material with a specific heat equal to water for 100° F. is $0.95. This is 10% to 75% more efficient than other methods available.

8. My novel unit is easier to physically relocate than any steam heating system, there being no need for a boiler or condensate return system. Units in accordance with my invention having current requirements up to 50 amperes may be completely portable systems, involving use with an extension cord, whereas units having current requirements greater than this are normally hard wired.

9. The unique strainer system I use enables continued circulation of the heat transfer liquid, even if debris such as paper or drum labels enter the system. It is but a simple matter to remove the strainer means for periodic cleaning.

10. My advantageously designed drum heating unit enables the amount of circulating heat transfer liquid to be minimized, thus making it possible to bring the contents of a drum safely up to a desired temperature in a minimum of time.

11. Safety features of my invention include a flow monitoring means in the form of a low flow warning unit to indicate that the strainer is plugging up, a liquid level warning device in the form of a low water level switch to indicate that the heat transfer liquid is not sufficiently covering the surface area of the drum of chemicals being heated, and a temperature sensing means for assuring that the heat transfer liquid is being maintained at a desired temperature.

It is therefore a principal object of this invention to provide a generally cylindrically shaped tub or tank into which a drum of chemicals to be heated can be placed and then raised to a desired temperature in a safe and economical manner.

It is another object of my invention to provide a drum heating arrangement in which a circulating fluid forms the interface between the heat source and the drum to be heated, with this arrangement preventing the drum from being heated to a temperature higher than that reached by the circulating liquid.

It is still another object of my invention to provide a drum heating device of low to modest cost utilizing a non-inflammable heat transfer liquid for transferring heat to a drum possibly containing hazardous material, with thermostatically controlled electrical heating means being utilized for supplying heat to the heat transfer liquid, at a location essentially isolated from the drum being heated.

It is yet another object of my invention to provide a drum-heating unit of relatively inexpensive construction making it readily possible for a drum of possibly hazardous material to be heated in a safe and rapid manner, with any possible leakage from the drum occurring during the heating procedure being advantageously contained in the heat transfer liquid.

It is yet still another object of this invention to provide a unique strainer system permitting highly effective and reliable circulation of the heat transfer liquid past the drum to be heated, and the ready removal of debris from the circulating liquid.

It is yet another object of this invention to configure a tub able to circulate liquid in a highly effective heat transfer relationship to a drum containing a chemical to be heated, with no more than 20 gallons of heat transfer liquid ordinarily being required during the heating process, thus minimizing the time and expense associated with the heating of the drum to a desired temperature.

It is yet still another object of my invention to provide a drum-heating unit of portable construction, which can be readily moved from one location to another in order that the heating of possibly hazardous material can be accomplished quickly and at a minimum labor expense.

These and other objects, features and advantages will be more apparent as the description proceeds.

DETAILED DESCRIPTION

Figure 1:
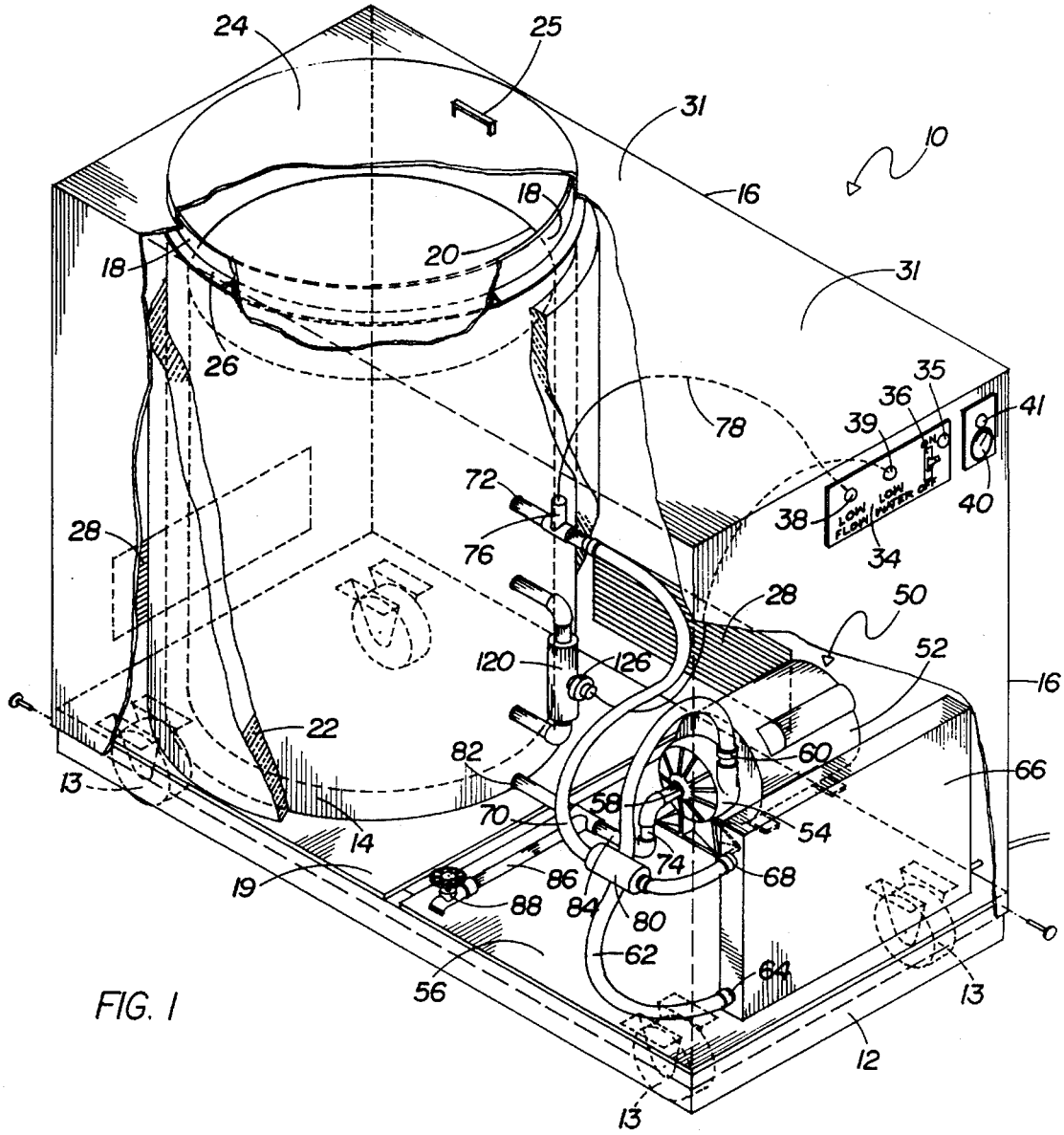
FIG. 1 is a perspective view of the essential components that constitute my novel drum heating unit, with certain portions of the cabinet broken away to reveal internal construction.

With initial reference to FIG. 1 it will be seen that I have provided a novel drum heating unit 10 designed to heat a drum of material to a selected temperature in an exceedingly safe manner. A principal ingredient of my drum heater unit is a tub or tank 14 of watertight construction that is designed to receive therein, a drum 20 containing a chemical or other material that is to be safely heated to the selected temperature by a circulating liquid. The tub or tank 14 may for convenience be mounted on a platform frame 12, which frame may be equipped with a plurality of wheels 13 in instances in which the drum heating unit is equipped with a power supply of a limited size, such as, for example, a power supply involving the flow of not more than 50 amperes of current. As is obvious, when wheels 13 are utilized on the bottom of the frame 12, the frame may be regarded as a cart.

Figure 1A:
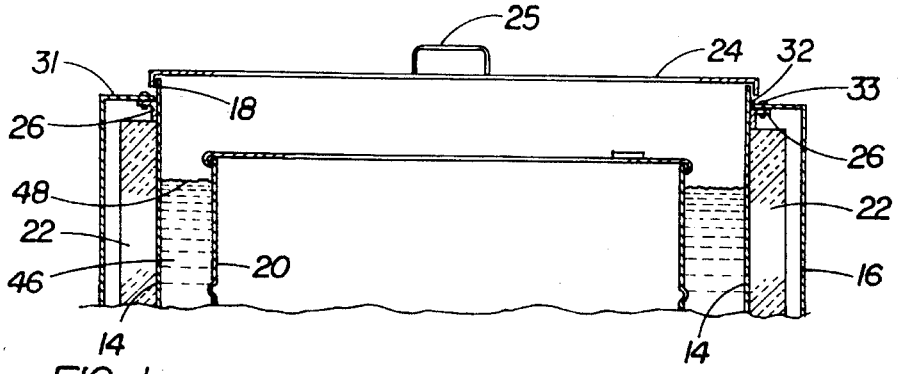
FIG. 1*a* is a fragmentary view showing in cross section, the upper part of my novel drum heating unit, with particular regard to the relationship of the sidewall of the drum to be heated to the sidewall of the tub, and the insulating material utilized to help a desired temperature to be maintained in the tub.

The tub 14 is preferably contained in a cabinet or housing member 16, the details of which will be set forth shortly. The tub 14 is preferably of stainless steel, although in some instances an industrial grade plastic may be utilized in its construction. The tub or tank 14 has relatively high sidewalls 18, and may rest upon a support plate or platform 19 attached to the platform frame 12. Insulating sidewalls 22 of relatively thick insulating material surround the tub or tank 14, as revealed in FIG. 1, so as to provide excellent heat retention qualities. FIG. 1*a* is a fragmentary view of the upper portion of the tub or tank, revealing a typical arrangement of certain of the foregoing components, and indicating that the liquid 46 contained in the tank 14 resides at a level 48 under the upper edge of the drum 20.

Figure 2:
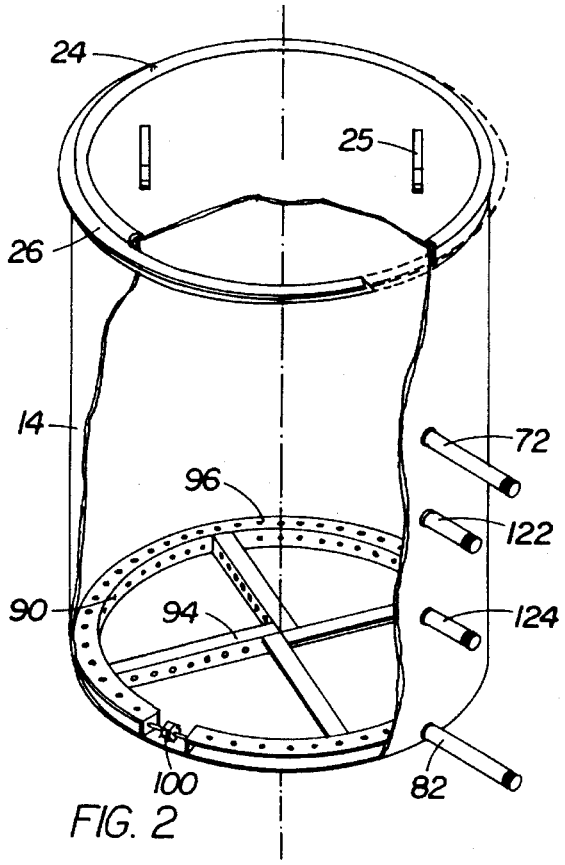
FIG. 2 is a perspective view of the novel tank or tub utilized in conjunction with my drum heating unit, with the insulation removed therefrom to reveal internal construction.

The tub 14 with insulation removed for clarity is to be seen in FIG. 2, where the tub is revealed to be of generally cylindrical configuration. The drum 20 to be received in the tub 14 can be a standard 55 gallon drum, or it may be of a substantially different size or configuration than this. The fittings utilized on the tab or tank will be described shortly.

The generally rectangularly-shaped cabinet or housing member 16 in which the tub 14 resides may be of a construction involving panels made of stainless steel, but obviously I am not to be limited to this. The cabinet 16 provides a suitable enclosure for the tub 14 as well as the components concerned with heating the heat transfer liquid, and the components utilized for bringing about the circulation of such heat transfer liquid through the tub 14 and around the drum 20.

As will be noted from FIG. 1, but even more clearly from FIG. 1*a*, the upper surface 31 of the cabinet or housing member 16 has an aperture 32 through which the relatively high sidewalls 18 of the tub 14 extend. The upper sidewalls 18 of the tub 14 may extend for approximately one-inch above the upper surface 31 of the cabinet 16, but I obviously am not to be limited to this. This type of arrangement makes it readily possible to utilize a closure member in the form of a tub cover or lid 24, which fits over the upper portion of the relatively high sides 18 of the tub 14, which tub cover may have one or more handles 25. This assures an adequate amount of heat retention during the procedure in which the contents of a drum 20 are being heated by the circulating heat transfer liquid 46.

As shown in FIG. 1, I may provide one or more air vents 28 in the sidewalls of the cabinet 16, which serve to keep the cabinet, the pump motor 52, and the electrical control panel 34 at a cooler temperature than the temperature selected for the heat transfer liquid circulating around the tub 14 and the drum contained therein. The pump motor 52 and the control panel 34 will be discussed hereinafter. The air vents 28 also serve to keep the cabinet interior dry in the event water is inadvertently spilled during the tub-filling procedure. Each air vent may be six inches high and twelve inches wide, but these dimensions are obviously not critical, and I am not to be limited to air vents of any particular size.

As shown in FIGS. 1*a* and 2, I prefer to utilize a mounting collar 26 around the upper part of the tub 14, with the collar secured, such as by welding to the tank, presuming of course that stainless steel rather than industrial grade plastic is used in the construction of the tank. The upper sidewalls 18 of the tub extend up through the aperture 32 in the upper surface 31 of the cabinet 16, and cabinet fastening screws 33 are utilized for holding the upper portion of the cabinet 16 to the collar 26.

The control panel 34 is mounted upon an upper portion of the cabinet or housing member 16, typically the upper front portion, as viewed in FIG. 1. The control panel has an on/off switch 36, a warning light 38 to indicate low liquid flow, and a warning light 39 to indicate that the level 48 of the heat transfer liquid in the tank or tub 14 is improper. A temperature adjustment device 40 is also provided on the control panel 34 in order to enable the operator to readily preset the temperature the circulating liquid 46 is to maintain. The temperature selecting arrangement is typically part of the heating unit, and will be discussed hereinafter, as will further details of the control panel 34.

The interior of the tub or tank 14 is of sufficient size that it can readily receive a standard 55 gallon drum 20 containing material to be heated, and by way of example, the tub 14 may have an inside diameter of 25¾", and have sidewalls 18 that are 39" high. The tub or tank 14 can obviously be configured to accept drums or containers of a size different from this, however.

The sidewalls 18 of the tub 14 are tall enough to readily permit the tub cover or closure member 24 to be placed on the sidewalls after the drum has been placed in the tub, and typically there is approximately three inches of clearance between the top of the drum 20 to be heated, and the cover 24.

The tub or tank 14 is preferably of 16 gauge 304 stainless steel, but obviously I am not to be limited to these dimensions or to the use of this material, for as previously mentioned, in some instances I can use a high grade of industrial plastic in the creation of the tub. As will be described hereinafter, and as depicted in FIGS. 1 and 2, four piping connections to the tub 14 are utilized, with two of these utilized in order that heat transfer liquid can be circulated throughout the tub while a drum is contained therein, and the other two utilized in connection with an arrangement for assuring that the liquid in the tub is maintained at a desired level or depth, or at least within high and low limits of the liquid level.

An electrically powered pump unit 50 is mounted on the mounting plate or platform 56, as indicated in FIG. 1, with the pump unit 50 preferably utilizing a motor 52 of 1/25 horsepower, typically operative at 120 volts, and driving a pump 54 arranged to circulate approximately three gallons of heat transfer liquid per minute through the tub or tank 14 and the heating means 66. The pump 54 has an inlet 58 and an outlet 60, with the liquid pumped by the pump 54 being delivered by a hose or pipe 62 to the inlet 64 of electric heater 66. As is obvious, I am not to be limited to the sizes of the pump and the motor mentioned above.

The heater or heating means 66 has an outlet 68 that connects to a hose or pipe 70 that is arranged to deliver heated transfer liquid to the inlet connection 72 of the tub or tank 14. As depicted in FIG. 2, the inlet connection 72 is placed relatively high on the side of the tank 14, but it is desirable that this connection be disposed at a location below the intended liquid level to be maintained in the tub. This is because it is desirable to create turbulence in the heat transfer liquid being circulated in the tub and around the drum being heated, in order to accomplish maximum heat transfer to the drum 20.

The electrically powered heating means 66 serving as a heat source for the liquid to circulate through the tub or tank 14 may for example be an 18,000 watt heater arranged to operate at 240 volts. This heating means has a differential pressure switch and a thermostatic arrangement such that heating ceases upon the heat transfer liquid reaching a selected temperature, such as, for example, a temperature approaching 212° F. Upon the heat transfer liquid cooling, however, the heating resumes, so that the desired temperature of the heat transfer liquid will be maintained. As mentioned hereinabove, the heat unit has a temperature adjustment device 40, which may be placed on or adjacent the control panel 34. The temperature adjustment device enables the operator to establish the temperature of the circulating liquid, and the heat unit I prefer to use may for example be manufactured by Keltech. Inc. of Richland, Mich. I am not to be limited to units made by this manufacturer, however, and the details of the heating means form no part of the present invention.

Figure 5:
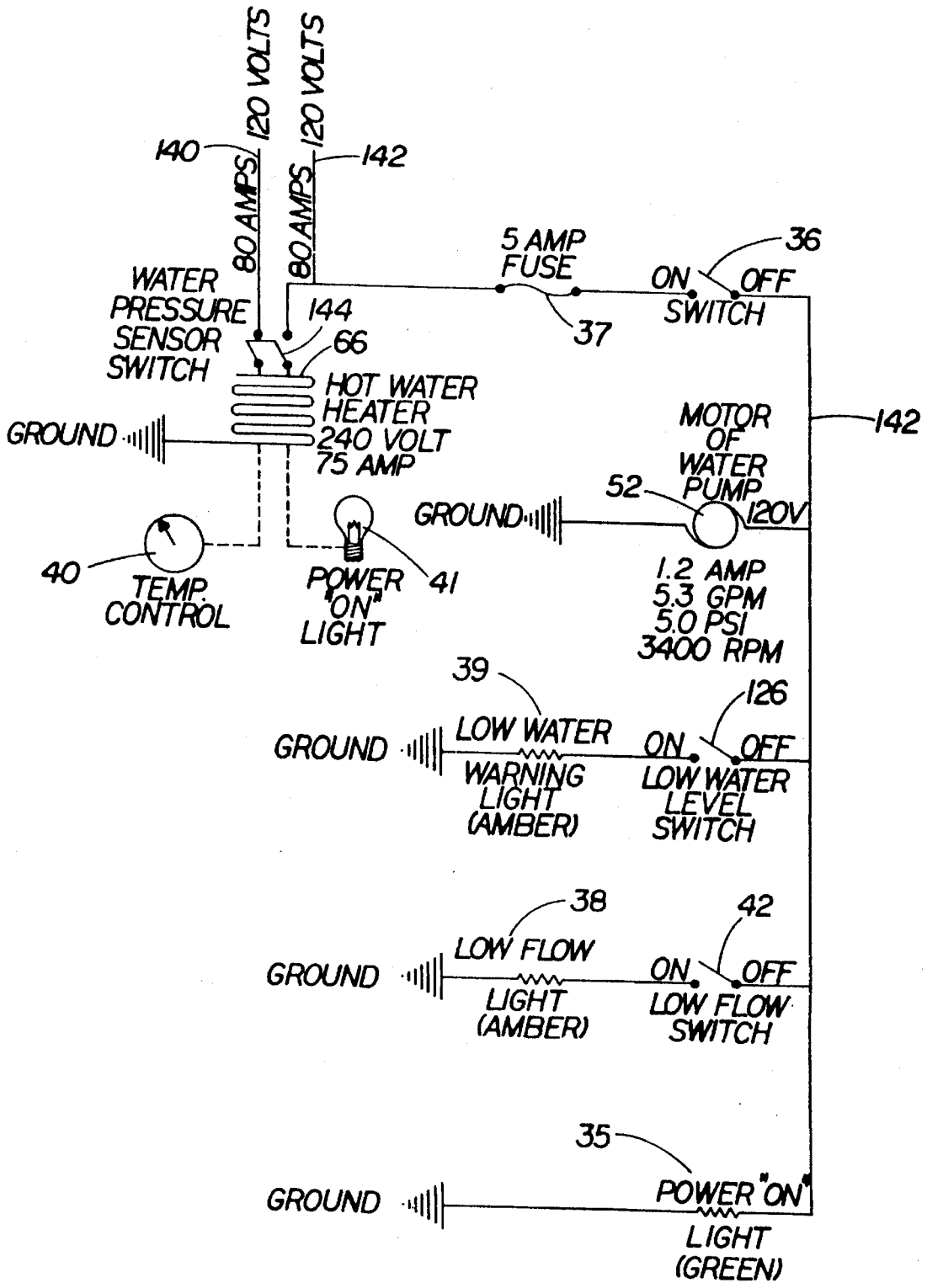
FIG. 5 is an electrical schematic of the arrangement by which my novel drum heating unit is operated.

As a safety feature, I may utilize a pressure sensor switch 144 in conjunction with the heating unit 66. The switch 144 is depicted in FIG. 5, and it is activated by water pressure from the pump 54 when the main switch 36 has been turned on. When the switch 144 is activated, it permits the line voltage, which may be 240 volts a.c., to be supplied to the heating unit 66. When a sufficient water pressure is not available, the heating unit 66 is inoperative.

I prefer for convenience to interpose a quick disconnect coupling or union 74 so that the pump 54 could be readily disconnected from the tub or tank 14 should the situation warrant; note FIG. 1. Also utilized in the hose or pipe 70 is a flow control unit 76 designed to indicate the sufficiency of the flow rate through the hose or pipe 70. The flow monitoring unit 76 may be of a type distributed by McMaster-Carr Supply Company of Elmhurst, Ill. The unit 76 contains a switch 42 and a suitable electrical connection 78 is provided to the previously-mentioned low flow warning light 38, so that a situation of improper flow rate can readily be brought to the attention of the operator.

While I am not to be limited to any one type of switch 42, it may for example be a vane type flow switch with a spring loaded relay. The vane can be trimmed to actuate and deactuate at a selected flow rate. The switch 42 would be normally closed when the rate of flow of the heat transfer liquid is less than a certain rate, such as 1.9 gallons per minute. In such an instance the warning light 38 is illuminated, presuming that the main switch 36 is in the on position. On the other hand, when the rate of flow of the heat transfer liquid exceeds, for example, two gallons per minute, the switch 42 opens or becomes deactuated, meaning of course that the yellow warning light 38 is extinguished.

I have found that the illumination of the low flow warning light 38, resulting from the operation of the switch 42, is often associated with the condition of the tub strainer system, involving the circular strainer 90 hereinafter described, needing cleaning.

Returning now to a further consideration of FIG. 2, it has previously been mentioned that I have shown the tub or tank 14 with the insulation removed for clarity, with this figure making clear that the inlet connection 72 is welded or otherwise secured in a leak-free manner to an upper sidewall of the tub or tank 14. The connection is below the liquid level to be maintained in the tank 14 and above the strainer system. Also depicted in this figure is the outlet connection 82, located very close to the bottom of the tank or tub.

FIG. 2 reveals that I provide an inner bottom water strainer 90 of generally circular configuration, which serves not only to remove debris from the circulating heat transfer liquid, but also, in some instances, to form a part of the support for the drum 20 to be heated. The circular strainer 90 is preferably made of 1"—304 stainless steel angle stock, and which contains a substantial number of relatively small holes 96, preferably of a consistent size. By relatively small, I mean to connote holes on the order of ⅛" diameter, which may be spaced approximately 1" apart. In one prototype, the inner bottom water strainer 90 was rolled to have an inner diameter of 23½", but obviously I am not to be limited to this particular material, to the diameter or spacing of the holes, nor to the diameter of the strainer member 90. The closed sides of the angle stock face toward the center of the tank, whereas the open portion of the angle members face outwardly, toward the circularly shaped bottom edge of the tank or tub 14. The circular strainer 90 is thus disposed in an operative relationship to the outlet portion of the tub 14. As is therefore to be seen, the construction is such that heat transfer liquid leaving the tub through the outlet connection 82 must pass through the numerous small holes 96 located in the strainer 90. The strainer 90 is readily removable, so that debris can be removed therefrom. Without this unique strainer design, utilizing numerous holes spread out over a comparatively large area, the liquid circulation system of this invention could easily be plugged up at the outlet connection 82 by material as relatively insignificant as a small piece of paper or plastic, such as from a label on the drum being heated.

The inner bottom water strainer 90 surrounds a center strainer support piece 94 that is of generally X-shaped or plus-shaped configuration, which is co-planar with the strainer 90. The holes provided in member 94 are for improved water circulation beneath the drum, but there are no plumbing connections associated with the support piece 94. The perforate member 94 may support a substantial portion of the weight of the drum 20 to be heated.

The outlet connection 82 provided near the bottom of the tank or tub 14 enables the flow path of the heat transfer liquid through the tank to be completed, with the pipe 84 connecting the outlet connection 82 to the inlet 58 of the pump 54, via the quick disconnect 74. As best seen in FIG. 1, the arrangement is such that heat transfer liquid can be returned to the pump and then circulated in a highly desirable manner around the tank or tub 14 and around the drum 20 containing the material to be heated. A drain connection 86 including a faucet 88 makes it possible for the operator to drain all of the heat transfer liquid out of the tub or tank 14 and the other components, should the situation warrant.

Figure 3:
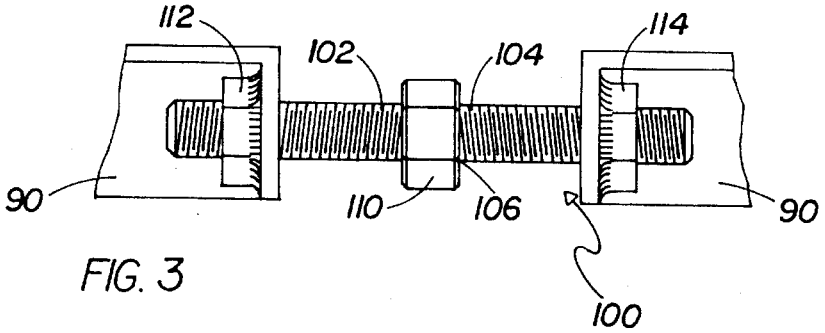
FIG. 3 is a view to a considerably larger scale, revealing the mechanism by which I may releasably secure the circularly-shaped inner bottom water strainer in the lower interior portion of the tank or tub.

Interposed in one portion of the circularly shaped inner bottom water strainer 90 is a fastening unit 100 of the type depicted in FIG. 3, which can be readily operated to expand the strainer unit 90 into tight contact with the bottom interior portion of the tub or tank 14, to prevent an undesired displacement thereof.

As revealed in FIG. 3, the fastening unit 100 utilizes a rotatable member 106 having left handed threads 102 and right handed threads 104. The left handed threads 102 operatively engage a nut 112 containing left handed internal threads, whereas right handed threads 104 operatively engage a nut 114 containing right hand internal threads. Both nuts 112 and 114 are welded or otherwise secured in a non-rotatable manner to the edges or corners of the inner bottom strainer unit 90. Upon a wrench or other suitable member being applied to the wrenching flats forming an intrinsic part of the center member 110, rotation of the rotatable member 106 can be brought about in a desired direction. As is obvious, when the member 106 is rotated in the tightening direction, it causes the inner bottom strainer 90 to tightly engage the circularly shaped bottom interior portion of the tub or tank 14, whereas rotation of the member 106 in the opposite direction brings about the loosening of the member 90 so that it can be readily removed from the tub or tank 14 for cleaning. As is obvious, the strainer 90 is oriented such that the tightening components of the fastening unit 100 are out of alignment with the outlet connection 82. It is typically necessary to remove the strainer for cleaning only once a year or so, for should the operation note a piece of debris, such as a paper or plastic label from a drum, the operator needs only to reach inside the tank to remove same, without it being necessary to remove the strainer.

Figure 4:
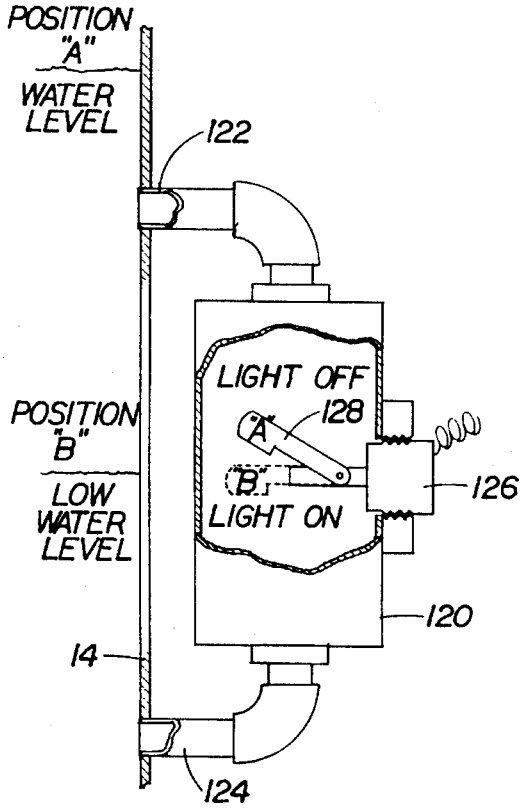
FIG. 4 is a view of certain aspects of the level control unit I utilize.

It is important that the level of the heat transfer liquid in the tub or tank 14 be maintained within acceptable limits, and to that end I provide a liquid level warning device 120, visible in FIG. 1 and revealed in greater detail in FIG. 4. The device 120 is located between the upper pipe or conduit 122 and the lower pipe or conduit 124, each of which is welded or otherwise secured in a leak-free manner to the sidewall of the tub or tank 14. The upper pipe 122 and the lower pipe 124 are arranged to communicate freely with the heat transfer liquid contained in the tub or tank 14, so that fluctuations in the liquid level can be readily communicated to the vicinity of an electric switch 126 contained in the warning device 120.

The warning device 120 is broken away in FIG. 4 to reveal the general manner in which the liquid level switch 126 is operatively mounted in the warning device 120, and to show the float arm 128, which serves to actuate the switch 126. The switch 126 would typically be disposed at a location corresponding to 60% of the desired height of the liquid in the tank 14.

The switch 126 is of course an intrinsic part of the liquid level warning device I utilize, and this may be a reed-style liquid level control switch, such as distributed by McMaster-Carr of Elmhurst, Ill. The switch 126 is a hermetically sealed, magnetically activated device actuated by a magnet operatively associated with the float arm 128. As the float arm rises and falls with changes of the liquid level in the tank or tub, the magnetic field passing the switch 126 opens and closes the switch. The opening and closing of the switch in response to such changes in liquid level is responsible for notifying the operator when it is desirable that more heat transfer liquid be added to the tub, which notification may be brought about by the illumination of the low water level warning light 39 provided on the control panel 34.

As indicated in FIG. 4, the water level may be maintained between a Position "A," representing the high water level, and a Position "B," representing the low water level. When the float arm 128 is in its position "A," the raised position, the switch 126 is electrically open, and the light 39 is off. However, when the liquid level in tank 14 drops out of the acceptable range of liquid level to a "Position "B," the float arm 128 moves to the generally horizontal position indicated in dashed lines in FIG. 4, causing the switch 126 to close the circuit to light 39, causing it to turn on, thus to signal the operator to add liquid to the tub 14.

I have found it is extremely important that the liquid level warning switch 126 be positioned above the elevation of the pump suction fitting, to prevent the loss of liquid suction to the pump 54, and thus to avoid possible damage to the pump. As is obvious, the switch 126 is in all instances a commercially available device, and no invention is associated with its particular design.

With reference now to FIG. 5 it will be seen that I have provided an indication of the circuitry that may be involved with my advantageous design, with this figure revealing the location of the heating means 66, and the electrical input lines 140 and 142. One of the input lines is 120 volts above ground, and the other is 120 volts below ground, so that 240 volts A.C. will be made available for powering the heater unit 66. Temperature control device 40 is provided for the convenience of the operator, and the arrangement is such that the selected temperature may be readily adjusted either upwardly or downwardly. Bulb 41 serves to indicate when the heater is on.

It will be recalled that I prefer to utilize a pressure sensor switch 144 in conjunction with the heating unit 66, which switch is depicted in FIG. 5, and which switch is activated by water pressure from the pump 54 when the main switch 36 has been turned on. When the switch 144 is activated, it permits the line voltage, which may be 240 volts a.c., to be supplied to the heating unit 66.

It will be noted the 120 volt line 142 is connected to on/off switch 36, with a fuse 37 being utilized between the line 142 and the on/off switch 36. From the switch 36 the line 142 continues so as to supply 120 volts to the motor 52 operatively connected to pump 54 of the pump unit 50, as well as to the low water level warning light 39. As previously described, the on/off switch 126 is utilized for controlling the operation of this warning light.

Somewhat similarly, the 120 volt line 142 supplies power to the low flow light 38, with a low flow switch 42, contained in the flow warning unit 76, controlling the operation of this light. Bulb 35 may be utilized to indicate to the operator when the switch 36 has been operated to supply electric power to the unit.

As to the operation of my device, it is typical to begin by filling the tub or tank 14 with approximately 15 gallons of heat transfer liquid, which in many instances can be water. Depending on the application, however, there may be instances in which I utilize propylene glycol, ethylene glycol, or other such liquids in the nature of automotive antifreeze. If water is used, the contents of the drum, quite advantageously, cannot be heated above the temperature of the boiling point of water, which of course at sea level is 212° F. Therefore, an intrinsic and significant safeguard associated with my device involves the fact that the drum of chemical or other material being heated cannot exceed the temperature of the boiling point of water, when water is being utilized as the heat transfer liquid, inasmuch as the drum is spaced away from and isolated from the heating means.

Continuing with regard to the operation of my device, upon the selected heat transfer liquid being added to the tub to a height equal to that of the drum 20, and the desired temperature set by means of the temperature control 40, the main switch 36 can be turned on.

The operator should be attentive, making sure that the light 38 indicates that there is a proper circulation of water, and that the heater light 41 is illuminated, showing that the heater has come on.

At this point, the cover or closure member 24 can be placed upon the tub, and the heating operation by the heating means commenced. The heating continues for a certain prescribed length of time, or until a certain temperature is reached, at which point the main switch 36 can be shut off.

It is to be noted that my novel unit can be operated quite economically, and I found that the typical cost of increasing the temperature of 55 gallons of material 100° F., when that material has a specific heat similar to or identical with the specific heat of water, is approximately 95 cents. This is 10% more efficient than some prior art methods, and 75% more efficient than other known methods.

My unit is much easier to relocate than a steam heating system, for my novel unit needs neither a boiler nor a condensate return system. As is known, a steam unit such as the SO4 Sahara Box is not designed for indoor use. The E4 Sahara Box utilizes heating elements that might under certain circumstances be exposed to flammable vapors. In contrast, my novel heating unit, being mounted on wheels, is completely portable, and an extension cord can be used therewith if the unit is of a size limited to a current flow of approximately 50 amperes.

Should the drum being heated spring a leak, the leaked liquid will advantageously be contained within the circulating system, and can be eliminated from the system by the use of a drain valve 88.

I claim:

1. A heating unit for heating a generally cylindrically shaped drum of material to a selected safe temperature without endangering the contents of the drum due to overheating, said heating unit comprising a tub, a liquid circulation means interconnected with said tub, and heating means for heating, to a selected temperature, the liquid to be circulated through said tub, said tub having relatively high sides and an interior portion configured to receive a drum therein, the interior portion of said tub adapted to contain a number of gallons of the liquid to be heated, said tub, liquid circulation means and heating means being interconnected, such that said liquid circulation means can bring about a substantially continuous flow of heated liquid through said tub, said heating means having a thermostatically controlled heating element for heating the liquid flowing through said heating means to a selected temperature, the operation of said liquid circulation means causing the circulation of liquid through said heating means and around a drum of material residing in said tub, thus to raise the temperature of the material contained in the drum to a temperature that does not exceed the temperature of the circulating liquid, circularly-shaped strainer means disposed in a bottom portion of said tub, in an operative relationship to said outlet port of said tub, with liquid flowing out of said tub necessarily flowing through said strainer means, said strainer means containing numerous holes of an approximately consistent size, said strainer means thus serving to intercept and retain debris of a size larger than said holes, and a perforate member of generally "X" shaped configuration disposed in a co-planar relationship to said circularly shaped strainer means, said perforate member serving to support at least some of the weight of the drum to be heated.

2. The heating unit for heating a generally cylindrically shaped drum of material to a selected safe temperature as recited in claim 1 in which a cabinet is disposed in a surrounding relationship to said tub, to said liquid circulation means, and to said heating means, said cabinet having an upper surface, said upper surface having an aperture through which said relatively high sides of said tub slightly protrude.

3. The heating unit for heating a generally cylindrically shaped drum of material to a selected safe temperature as recited in claim 2 in which the upper portion of said relatively high sides of said tub is configured to receive a closure member, said closure member serving to retain heat during the procedure in which a drum has been placed inside said tub and is being heated.

4. The heating unit for heating a generally cylindrically shaped drum of material to a selected safe temperature as recited in claim 1 in which the circulating liquid is water, with the temperature limit of the heating of the material in the drum thus being limited to the temperature of the boiling point of water.

5. The heating unit for heating a generally cylindrically shaped drum of material to a selected safe temperature as recited in claim 1 wherein a fluid level warning device is operatively associated with said tub, for monitoring the level of fluid residing in the tub at any one time.

6. The heating unit for heating a generally cylindrically shaped drum of material to a selected safe temperature as recited in claim 1 in which flow monitoring means are operatively associated with said liquid circulation means, for providing an indication of the rate of flow of liquid through said tub.

7. The heating unit for heating a generally cylindrically shaped drum of material to a selected safe temperature as recited in claim 1 in which temperature sensing means are operatively associated with said heating means, for controlling the temperature of the liquid circulating through said tub.

8. The heating unit for heating a generally cylindrically shaped drum of material to a selected safe temperature as recited in claim 1 in which circularly-shaped strainer means are disposed in a bottom portion of said tub, in an operative relationship to said outlet port of said tub, with liquid flowing out of said tub necessarily flowing through said strainer means.

9. The heating unit for heating a generally cylindrically shaped drum of material to a selected safe temperature as recited in claim 8 in which fastening means are utilized for causing said circularly shaped strainer means to be secured in an operative relationship to said outlet port of said tub, said strainer means being readily removable for cleaning.

10. The heating unit for heating a generally cylindrically shaped drum of material to a selected safe temperature as recited in claim 8 in which said strainer means contains numerous holes of an approximately consistent size, said strainer means thus serving to intercept and retain debris of a size larger than said holes.

11. A heating unit for heating a generally cylindrically shaped drum of material to a selected safe temperature without endangering the contents of the drum due to overheating, said heating unit comprising a tub, a liquid circulation means interconnected with said tub, and heating means for heating liquid to be circulated through said tub to a selected temperature, said tub having relatively high sides and an interior portion configured to receive a drum therein, the interior portion of said tub adapted to contain a number of gallons of the liquid to be heated, said tub and said liquid circulation means each having an inlet port and an outlet port, with the inlet port of said liquid circulation means being connected to said outlet port of said tub, and the outlet port of said liquid circulation means connected via said heating means to said inlet port of said tub, said heating means having a thermostatically controlled heating element for heating the liquid flowing through said heating means to a selected temperature, the operation of said liquid circulation means causing the circulation of liquid through said heating means and around the drum of material residing in said tub, thus to raise the temperature of the material contained in the drum to a temperature that does not exceed the temperature of the circulating liquid, circularly-shaped strainer means disposed in a bottom portion of said tub, in an operative relationship to said outlet port of said tub, with liquid flowing out of said tub necessarily flowing through said strainer means, and a perforate member of generally "X" shaped configuration disposed in a co-planar relationship to said circularly shaped strainer means, said perforate member serving to support at least some of the weight of the drum to be heated.

12. The heating unit for heating a generally cylindrically shaped drum of material to a selected safe temperature as recited in claim 11 in which a cabinet is disposed in a surrounding relationship to said tub, to said liquid circulation means, and to said heating means, said cabinet having an upper surface, said upper surface having an aperture through which said relatively high sides of said tub slightly protrude.

13. The heating unit for heating a generally cylindrically shaped drum of material to a selected safe temperature as recited in claim 12 in which the upper portion of said relatively high sides of said tub is configured to receive a closure member, said closure member serving to retain heat during the procedure in which a drum has been placed inside said tub and is being heated.

14. The heating unit for heating a generally cylindrically shaped drum of material to a selected safe temperature as recited in claim 11 in which the circulating liquid is water, with the temperature limit of the heating of the material in the drum thus being limited to the temperature of the boiling point of water.

15. The heating unit for heating a generally cylindrically shaped drum of material to a selected safe temperature as recited in claim 11 wherein a fluid level warning device is operatively associated with said tub, for monitoring the level of fluid residing in the tub at any one time.

16. The heating unit for heating a generally cylindrically shaped drum of material to a selected safe temperature as recited in claim 11 in which flow monitoring means are operatively associated with said liquid circulation means, for providing an indication of the rate of flow of liquid through said tub.

17. The heating unit for heating a generally cylindrically shaped drum of material to a selected safe temperature as recited in claim 11 in which temperature sensing means are operatively associated with said heating means, for controlling the temperature of the liquid circulating through said tub.

18. The heating unit for heating a generally cylindrically shaped drum of material to a selected safe temperature as recited in claim 11 in which circularly-shaped strainer means are disposed in a bottom portion of said tub, in an operative relationship to said outlet port of said tub, with liquid flowing out of said tub necessarily flowing through said strainer means.

19. The heating unit for heating a generally cylindrically shaped drum of material to a selected safe temperature as recited in claim 18 in which fastening means are utilized for causing said circularly shaped strainer means to be secured in an operative relationship to said outlet port of said tub, said strainer means being readily removable for cleaning.

20. The heating unit for heating a generally cylindrically shaped drum of material to a selected safe temperature as recited in claim 18 in which said strainer means contains numerous holes of an approximately consistent size, said strainer means thus serving to intercept and retain debris of a size larger than said holes.

21. A heating unit for heating a generally cylindrically shaped drum of material to a selected safe temperature without endangering the contents of the drum due to overheating, said heating unit comprising a tub having relatively high sides and an interior portion configured to receive a drum therein, liquid circulation means interconnected with said tub, and heating means for heating, to a selected temperature, the liquid to be circulated through said tub, the interior portion of said tub adapted to contain a number of gallons of the liquid to be heated, strainer means operatively disposed in a lower portion of said tub, with inlet means and outlet means operatively associated with said strainer means, said tub, strainer means, liquid circulation means and heating means being interconnected, with said heating means having a thermostatically controlled heating element for heating the liquid flowing through said heating means to a selected temperature, the operation of said liquid circulation means causing the circulation of liquid through said strainer means, said heating means and around a drum of material residing in said tub, thus to raise the temperature of the material contained in the drum to a temperature that does not exceed the temperature of the circulating liquid, and flow monitoring means operatively associated with said liquid circulation means, for providing an indication of an insufficient rate of flow of liquid through said strainer means, such as by a clog occurring in said strainer means.

22. A heating unit for heating a generally cylindrically shaped drum of material to a selected safe temperature as recited in claim 21 in which said strainer means is made of rigid angle stock, and contains a substantial number of relatively small holes, through which holes the circulating liquid flows.

23. A heating unit for heating a generally cylindrically shaped drum of material to a selected safe temperature without endangering the contents of the drum due to overheating, said heating unit comprising a tub, said tub being equipped with relatively high sides and having liquid circulation means operatively associated therewith, the interior portion of said tub being configured to receive therein a drum containing material to be heated, strainer means in the bottom of said tub with which the drum of material to be heated can be in direct contact, inlet means and outlet means operatively associated with said strainer means, and heating means for heating, to a selected temperature, the liquid to be circulated through said tub, said tub, liquid circulation means, heating means and strainer means being interconnected, such that said liquid circulation means can bring about a substantially continuous flow of heated liquid through said strainer means and around the drum, said heating means having a thermostatically controlled heating element for heating the liquid flowing through said heating means and around said the drum of material residing in the tub to a selected temperature, thus to raise the temperature of the material contained in the drum to a temperature that does not exceed the temperature of the circulating liquid, and flow monitoring means operatively associated with said liquid circulation means, for providing an indication of an insufficient flow through said strainer means, such as caused by a clog occurring in said strainer means.

24. A heating unit for heating a generally cylindrically shaped drum of material to a selected safe temperature as recited in claim 23 in which said strainer means is made of rigid angle stock, and contains a substantial number of relatively small holes, through which holes the circulating liquid flows.

* * * * *